United States Patent [19]

Stoehr

[11] Patent Number: 4,724,695

[45] Date of Patent: Feb. 16, 1988

[54] QUICKLY CONVERTIBLE ROLLER FORMING MACHINE

[75] Inventor: Herbert M. Stoehr, New Berlin, Wis.

[73] Assignee: Artos Engineering Company, New Berlin, Wis.

[21] Appl. No.: 939,417

[22] Filed: Dec. 8, 1986

[51] Int. Cl.[4] ..... B21B 31/08

[52] U.S. Cl. ..... 72/181; 72/176; 72/226; 72/234

[58] Field of Search ..... 72/181, 179, 176, 164, 72/226, 234, 237

[56] References Cited

U.S. PATENT DOCUMENTS

| | | | |
|---|---|---|---|
| 1,833,376 | 11/1931 | Simmons | 72/226 |
| 3,251,210 | 5/1966 | Werntz | 72/181 |
| 3,750,446 | 8/1973 | Jones, Jr. | 72/234 |
| 3,796,081 | 3/1974 | Boardman | 72/181 |
| 4,142,393 | 3/1979 | Nagel | 72/181 |
| 4,557,129 | 12/1985 | Lash et al. | 72/181 |

FOREIGN PATENT DOCUMENTS

| | | | |
|---|---|---|---|
| 9533 | 1/1982 | Japan | 72/179 |

*Primary Examiner*—Daniel C. Crane
*Attorney, Agent, or Firm*—James E. Nilles

[57] ABSTRACT

Paired roller carrying shafts of a roller forming machine are arranged in two side-by-side sets on a table normally supported on a fixed base but elevatable for 180° rotation. Thus, either selected one of the two sets can be in operation, coupled to drive heads on the base, along one side of it, while the other set is idle, adjacent to the opposite side of the base for possible change of forming rollers. One end portion of every roller shaft is journaled in an outboard support that is near a side edge of the table; its opposite end portion is journaled in an inboard support near the longitudinal centerline of the table. To facilitate change of forming rollers, gears for connecting the upper and lower roller shaft of each pair are secured to their inboard end portions and the outboard supports are detachably mounted on the table. Axially movable clutch members on the drive heads provide for their quick connection to and disconnection from outboard ends of roller shafts of the set in the operative position.

9 Claims, 7 Drawing Figures

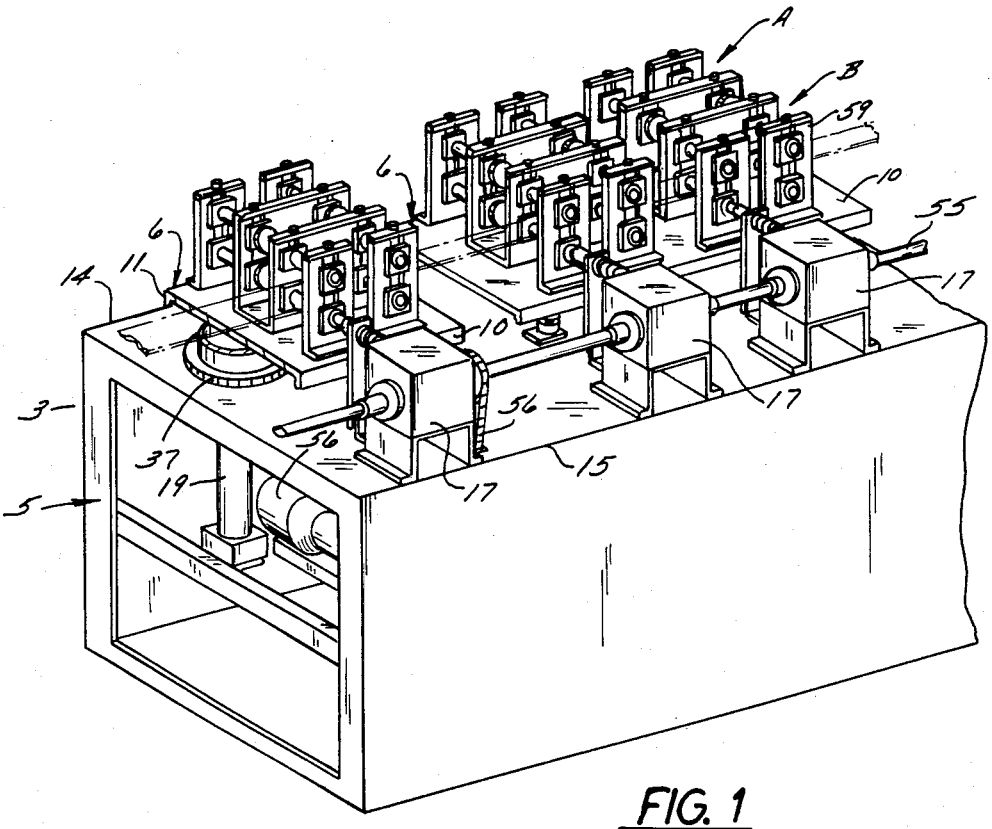
FIG. 1
FIG. 2
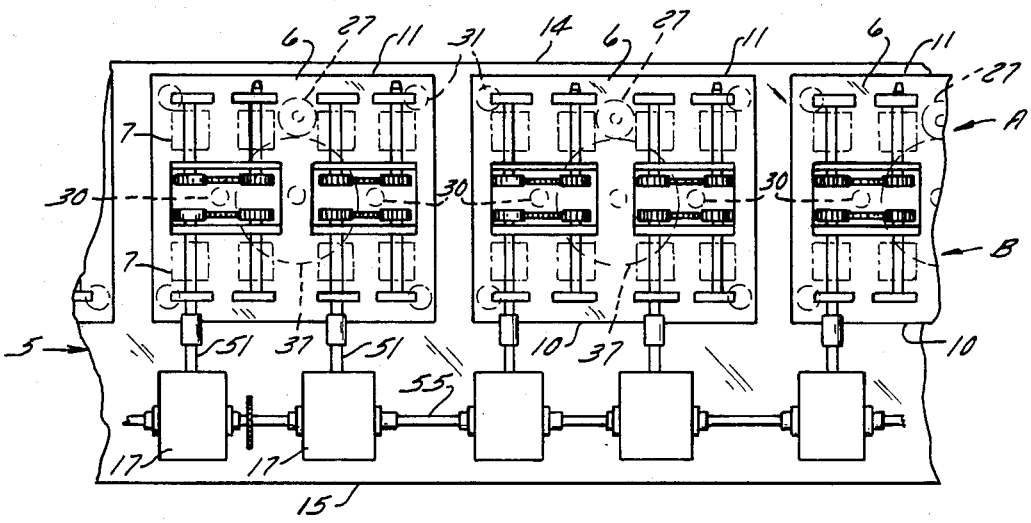

QUICKLY CONVERTIBLE ROLLER FORMING MACHINE

FIELD OF THE INVENTION

This invention relates to roller forming machines wherein an elongated sheet metal workpiece moves lengthwise along a defined path between paired forming rollers which produce a transverse bend in the workpiece that extends along its length; and the invention is more particularly concerned with a roller forming machine that can be quickly converted from production of workpieces of one type to production of workpieces of another type.

BACKGROUND OF THE INVENTION

The forming rollers of a roller forming machine are arranged in mating pairs, with the two rollers of each pair configured to produce a predetermined lateral deformation of an elongated sheet metal workpiece passing lengthwise between them. Normally such a machine comprises several pairs of forming rollers, located at spaced intervals along the path traversed by the workpiece and cooperating to impart a progressive deformation or bend to the workpiece as it moves through successive forming roller pairs along that path.

Although an endless variety of transverse profiles can be imparted to workpieces with a roller forming machine, the production of every different profile requires the use of a different set of forming rollers. For versatility, most roller forming machines are designed for interchangeable forming rollers, but changing forming rollers for running a different type of workpiece is nevertheless time-consuming.

Each forming roller is detachably fixed to a forming roller shaft, and the two roller shafts for each forming roller pair have their opposite end portions journaled in bearings that are mounted in a pair of upright support stands, one at each side of the machine frame. For driving the roller shafts in rotation, a line shaft extends along one side of the frame, at the outboard side of the support stands at that side. In heretofore conventional roller forming machines, gears have been secured to the roller shafts near their ends adjacent to the line shaft, for drivingly connecting the roller shafts with the line shaft and for constraining the two roller shafts of each pair to rotate at like speeds but in opposite directions. The support stands at the ends of the roller shafts remote from the line shaft were detachably secured to the machine frame so that upon their removal the forming rollers could be slid axially off of and onto the roller shafts.

Thus, interchange of forming rollers for conversion to production of a different type of workpiece has involved, among other things, removal and reinstallation of all of the support stands along the side of the machine remote from the line shaft and therefore has usually taken a time measurable in hours. Heretofore a roller forming machine has been out of production all during the time needed for such a changeover.

Where production runs are long for each different type of workpiece, the down time needed for occasional conversion by interchange of forming rollers is not of great consequence because it is small in proportion to production time. But with the increasing adoption of "just in time" production scheduling, intended to minimize inventories of partly finished materials, there has developed a need for short but economical production runs. For this, reduction of down time to an absolute minimum is imperative.

In the present state of the art it does not seem probable that the time required for interchange of forming rollers on the roller shafts of a roller forming machine can be materially reduced, especially in the case of the high-performance, heavy duty roller forming machines typically needed in situations where short runs and frequent conversions are the rule.

An obvious but impractical solution is to have two roller forming machines available, each to be used for production while the other is down for conversion. Aside from the unduly high capital investment in two such machines—each rather expensive in itself—and in the valuable floor space they would occupy, there is the further consideration that a roller forming machine is usually present as one element of a processing line that comprises other machines such as a punch press, a cut-off machine, a conveyor, and so on. Since the roller forming machine must be physically aligned with the other machines with which it cooperates, to provide for smooth flow of materials along the processing line, resort to a second roller forming machine for minimizing down time would practically compel the uneconomical provision of a second complete processing line that would be out of operation during about half of the time.

In one attempt at reducing the down time required for conversion of a roller forming machine, the machine has been constructed as a stationary main frame arranged to receive a set of removable forming roller subassemblies, each of which comprised a subframe carrying a few pairs of roller shafts, their forming rollers, their support stands and their gearing. The user of the machine had two or more sets of such forming roller subassemblies that were interchangeable with one another on the stationary main frame, each set having forming rollers adapted to produce a particular type of workpiece. The drive means for the roller shafts, comprising a line shaft driven by a motor, was permanently mounted on the main frame. For conversion from one type of workpiece to another, the drive means was disconnected from the subassemblies then mounted on the main frame, and each subassembly in turn was lifted off of the main frame by means of an overhead crane, which carried it away to storage. The crane returned with a replacement subassembly, adapted for a new workpiece to be produced, and lowered it into position on the main frame. The drive means then had to be connected with the replacement subassemblies to prepare the machine for beginning the new production run.

Disconnection of the subassemblies from the drive means was a time consuming operation involving individual disconnection of splined elements; and reconnection of the new subassemblies with the drive means took even longer. In addition, a substantial amount of time was taken up by the several back and forth trips of the overhead crane. Of course the need for an overhead crane—which was not always available—was an obvious disadvantage. Although there was some saving in down time, the time required for interchange of subframes was by no means short, so that the obviously high cost of this solution was not in all cases justified by the results obtained with it.

SUMMARY OF THE INVENTION

The general object of this invention is to provide a high-production, heavy-duty roller forming machine that presents an economically advantageous solution to the above discussed problem of minimizing the down time required for conversion from production of workpieces of one type to production of workpieces of another type, the machine of this invention being thus convertible in a matter of a very few minutes without the use of any equipment external to the machine itself.

Another and more specific object of this invention is to provide a compact and relatively inexpensive roller forming machine wherein the roller shafts on which the forming rollers are mounted are disposed in two side-by-side sets and which is so arranged that the roller shafts of one set and the forming rollers mounted on them can be in operation while forming rollers are being interchanged on the other set of roller shafts, said machine being further so arranged that a selected one of the two sets of roller shafts can be shifted from an inoperative position to an operative position and connected with driving means during a down time on the order of two minutes.

Another object of this invention is to provide a roller forming machine meeting all of the above stated objectives, comprising two sets of forming roller shafts that are shiftably mounted in such a manner that each set can be alternatively and selectably brought to an operative position while the other is brought to an inoperative position, and further comprising a single drive system for the forming roller shafts of both sets, adapted to be connected to or disconnected from the set at the operating position in a matter of a few seconds but nevertheless having very secure driving engagement with those forming roller shafts when connected.

It is also an object of the invention to provide a compact, quickly convertible roller forming machine which has two side-by-side sets of forming roller shafts, to be capable of producing either of two types of workpieces, and which can be very quickly converted from operation with one of those sets of roller shafts to operation with the other set, said machine being so arranged that the set of roller shafts which is idle at any given time is readily accessible for replacement of its forming rollers even though every roller shaft on the machine has sturdy support from two support stands, one of which must be removed to permit replacement of the forming roller on the shaft.

A further and more specific object of the invention is to provide a quickly convertible roller forming machine which achieves the above stated objectives and wherein either of the two sets of roller shafts can be quickly and accurately shifted to bring it to an operative position in alignment with other machines of a processing line in which the roller forming machine is incorporated, such shifting being accomplished without the use of equipment external to the roller forming machine itself.

These and other objects of the invention that will appear as the description proceeds are achieved in the roller forming machine of this invention, which comprises a plurality of lengthwise parallel rotatable roller shafts that are disposed in pairs, each pair comprising an upper roller shaft and a lower roller shaft, to each of which one of a pair of mating forming rollers is detachably securable. The machine is characterized by a frame having a pair of opposite sides and driving means on said frame, adjacent to one of said sides thereof. The driving means comprises rotatable clutch means shiftable away from said one side of the frame to a driving position and shiftable towards that side of the frame to a retracted position, means for driving said clutch means in rotation, and means for shifting the clutch means alternatively and selectably to each of its said positions. The machine is further characterized by an elongated table having a pair of opposite lengthwise extending sides and on which said roller shafts are confined to rotation and disposed with their lengths transverse to said sides of the table. The roller shafts are arranged on said table in two sets, one of those sets being laterally inwardly adjacent to each of said sides of the table and each said set comprising a plurality of pairs of roller shafts that are spaced apart along its adjacent side of the table. Table shifting means on the frame, connected with the table, provides for moving the table vertically and for rotating it through 180°. The table is moved vertically between an elevated position in which it is spaced above the level of the tops of the driving means and a lowered operative position. The table shifting means rotates the table in its elevated position through 180° about a vertical axis intermediate said sides of the table so that the table, when lowered to its operative position, can have a selected one of its two sets of roller shafts adjacent to said driving means. Further, the machine has rotatable input shaft means on the table for each of said sets of roller shafts, the input shaft means for each set of roller shafts being connected with the roller shafts of its set for rotatably driving the same, projecting towards the side of the table adjacent to its set, and being adapted for driving connection with said clutch means when its set of roller shafts is adjacent to said driving means and the clutch means is in its driving position.

Another characterizing feature of the roller forming machine of this invention is that each of its pairs of roller shafts is journaled in an outboard support stand that is inwardly adjacent to the side of the table nearest the roller shafts and an inboard support stand that is near the longitudinal centerline of the table; gears secured to the roller shafts of the pair, for constraining them to rotate in unison, are adjacent to the inboard support stand; and the outboard support stand is removably mounted on the table to provide for removal and replacement of forming rollers on the roller shafts.

BRIEF DESCRIPTION OF DRAWINGS

In the accompanying drawings, which illustrate what is now regarded as a preferred embodiment of the invention:

FIG. 1 is a more or less diagrammatic fragmentary perspective view of the middle portion of a roller forming machine embodying the principles of this invention;

FIG. 2 is a plan view of a portion of the machine;

DETAILED DESCRIPTION OF PREFERRED EMBODIMENT OF THE INVENTION

Figure 3:
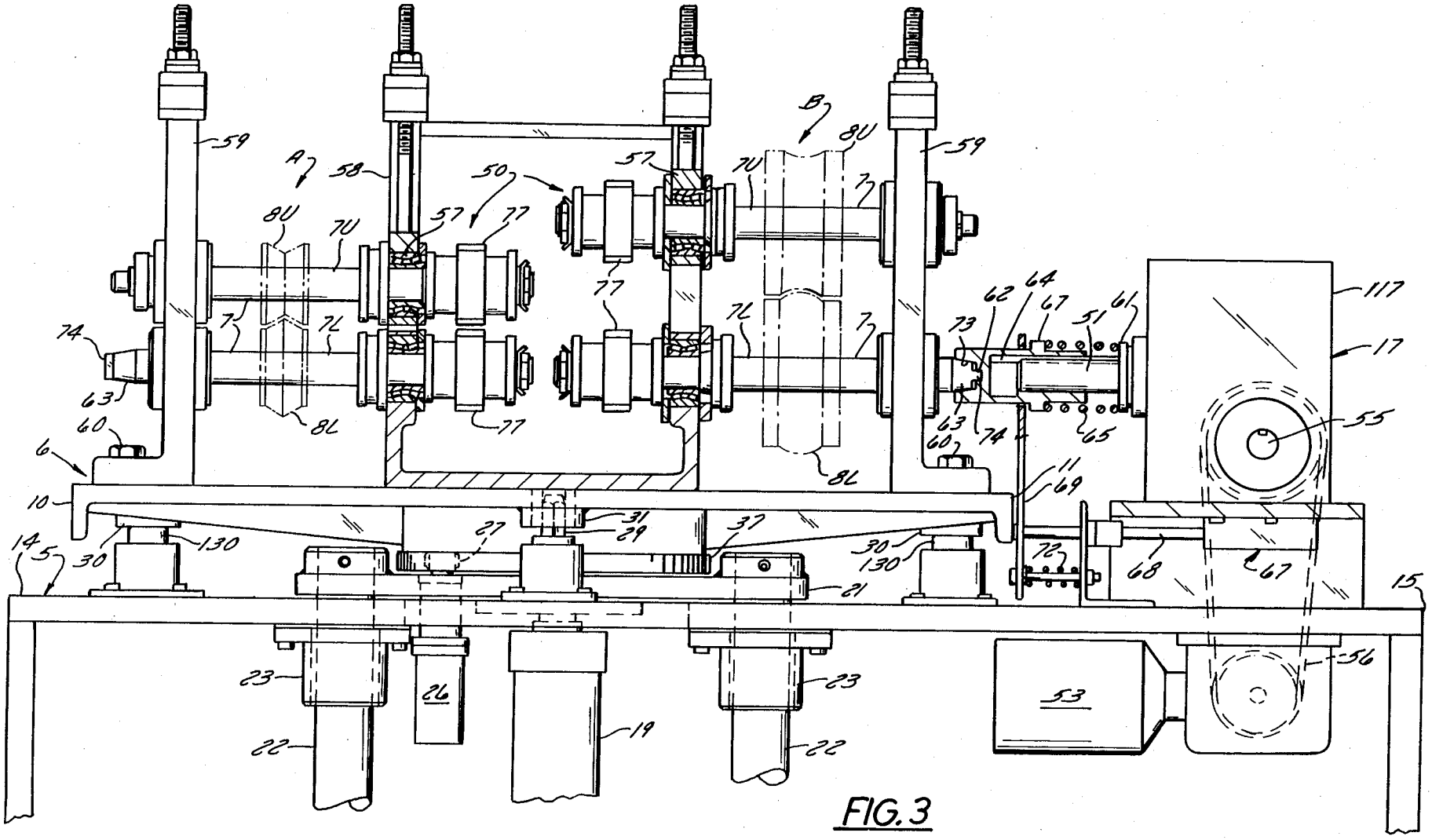
FIG. 3 is a view of the machine in section, taken on a laterally extending vertical plane near the axis of rotation of a table.
Figure 4:
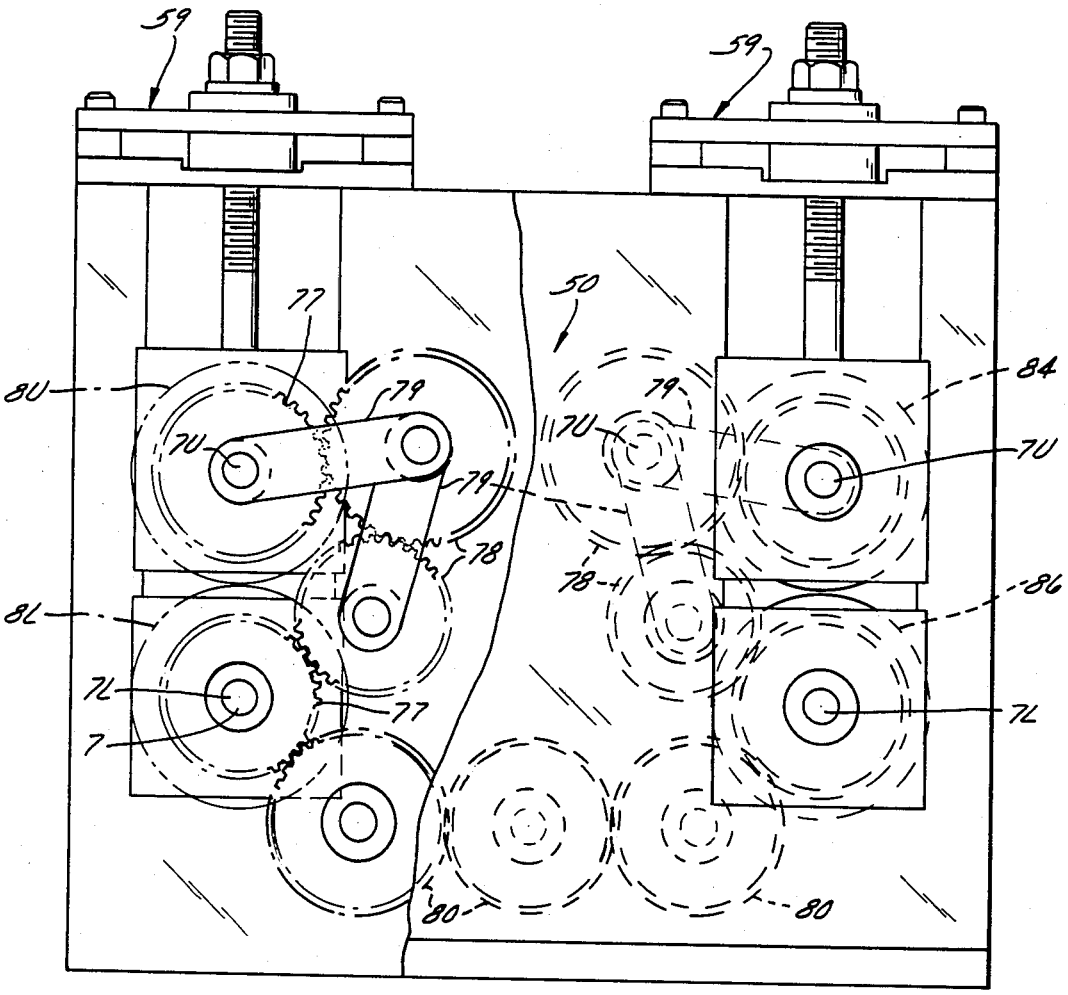
FIG. 4 is a side view of the transmission means for one group of roller shafts.
Figure 5:
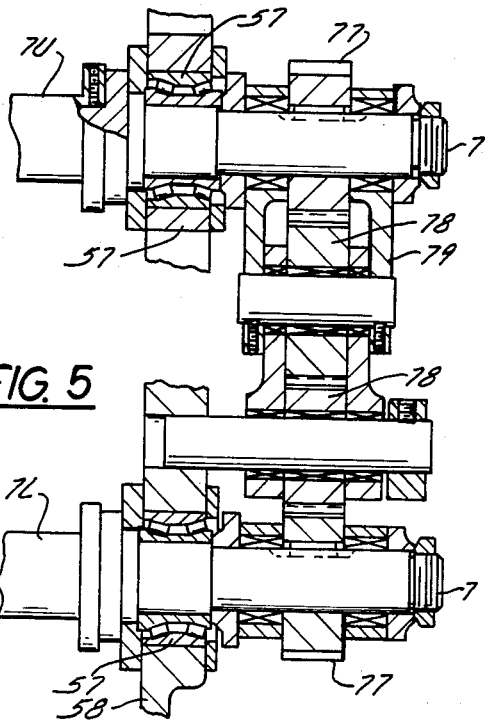
FIG. 5 is a fragmentary view in vertical section, taken on a plane transverse to that of FIG. 4, showing the transmission means drivingly connecting the roller shafts of a pair.
Figure 6:
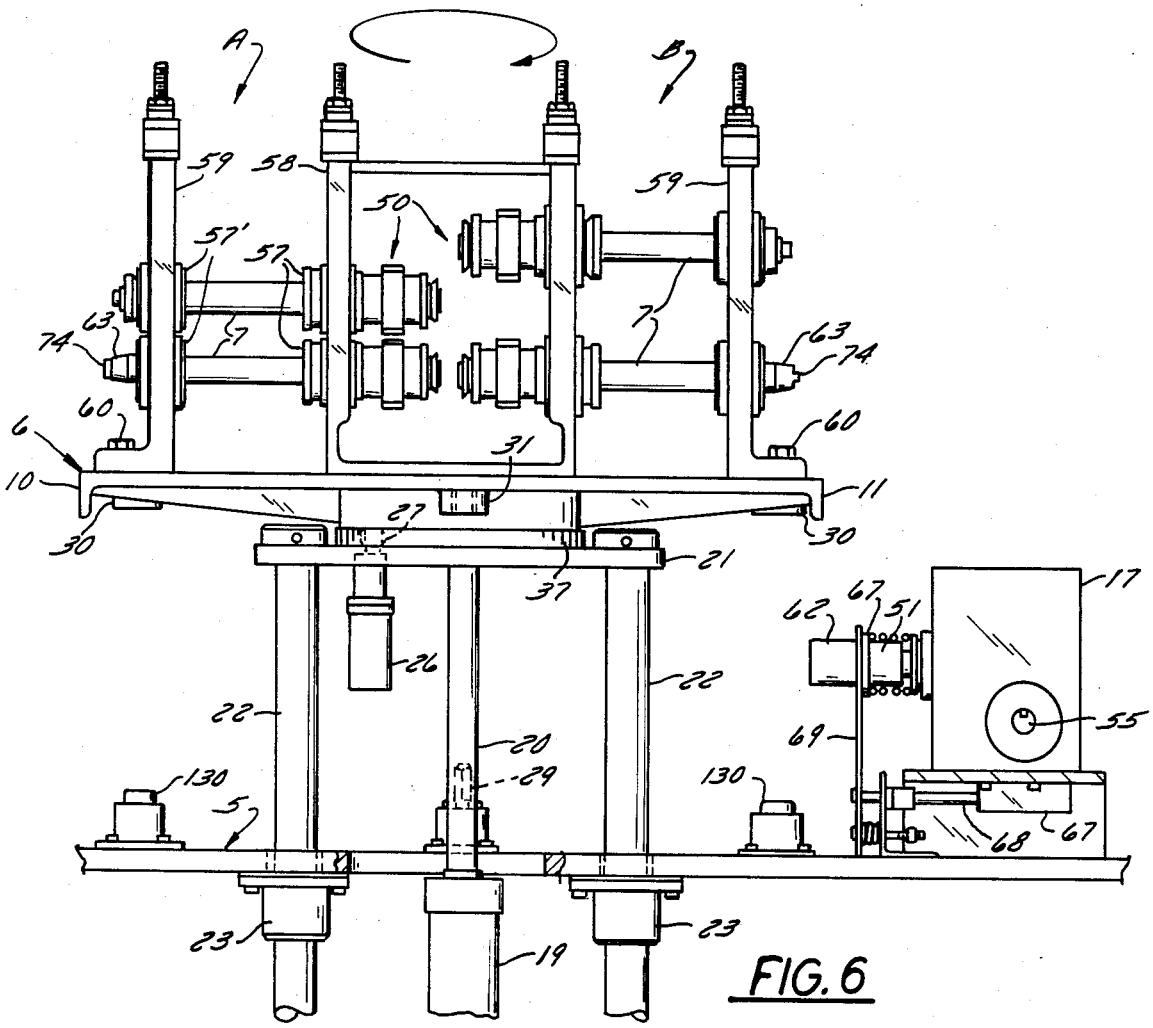
FIG. 6 is a view in transverse vertical section, taken substantially on the axis of rotation of the table, showing the table in its elevated position.

The roller forming machine of this invention comprises, in general, a relatively stationary frame or base 5 and at least one rectangular table 6 that can be raised and lowered relative to the frame 5 and can be rotated through 180° when it is in an elevated position. Mounted on the table and confined to rotation relative to it are forming roller shafts 7, each of which is adapted to carry a forming roller 8 that is detachably fixed to it. Every roller shaft 7 is oriented to have its length lateral to the table. The roller shafts 7, as is conventional, are arranged in pairs, each pair consisting of an upper roller shaft 7U and a lower roller shaft 7L, and it will be understood that the forming rollers 8U and 8L on the respective roller shafts of the pair are configured to mate with one another for cooperation in imparting a predetermined transverse bend or deformation to a workpiece passed between them.

The pairs of roller shafts 7 on the rectangular table 6 are arranged in two side-by-side sets A and B, there being one of such sets adjacent to each of the opposite longitudinally extending sides 10, 11 of the table. Thus, every roller shaft of each set has an outboard end adjacent to one side 10 or 11 of the table and has an inboard end which is adjacent to the longitudinal centerline of the table and to the inboard end of a roller shaft of the other set. The roller shaft pairs of each set are spaced apart at intervals—preferably uniform intervals—along the length of the table. Although the roller shafts 7 of the two sets can be identical, it will be understood that the forming rollers 8 mounted on the roller shafts of set A will normally be different from those mounted on the roller shafts of set B, so that each set is adapted to produce a workpiece different from that produced by the other. Only a selected one of the two sets of roller shafts will be operative at any given time, while the other set remains idle.

When the machine is in operation, the table 6 rests on top of the frame 5 with the longitudinal sides 10 and 11 of the table adjacent and parallel to longitudinal sides 14 and 15 of the frame. For rotatably driving the roller shafts 7 of the operative set, a number of driving heads 17 are mounted on the frame, at fixed locations adjacent to its side 15 and at spaced intervals along the length of that side. For production, the table 6 is so oriented on the frame 5 that the roller shafts 7 of the operative set are adjacent to the side 15 of the frame, and those roller shafts are drivingly connected with the driving heads 17. Meanwhile, the roller shafts 7 of the other set are adjacent to the opposite side 14 of the frame, where they are idle and are accessible so that the forming rollers 8 on them can be removed and replaced by other forming rollers during the time that the operative set is used for a production run.

For conversion to production of a different workpiece, the driving heads 17 are disconnected from the operative set of roller shafts, as explained hereinafter; the table 6 is raised to an elevated position in which it is above the level of the tops of the driving heads; and the table is then rotated through 180° about a vertical axis that extends through its geometrical center. This rotation brings the table to an orientation at which it can be lowered back down to its operative position resting on the frame 5, with the previously idle set of roller shafts now adjacent to the side 15 of the frame and to the driving heads 17. With the table back in its operative position, the driving heads 17 are connected with the roller shafts of the previously idle set, for putting them into production, while the previously operative set of roller shafts is now idled and adjacent to the other side 14 of the frame where it is accessible for an interchange of forming rollers if one is needed for the next following production run.

The number of roller pairs, or so-called passes, needed for most roller forming operations is such that it would not be practicable to mount all of them on a single elevatable and rotatable table. In accordance with the present invention, therefore, two or more tables 6 with their roller shafts 7 are mounted along the length of the frame or base 5, so arranged as to be disposed end to end when they are in their lowered operative positions on the frame, with their operative sets of roller shafts defining a straight and continuous workpiece path. As a practical matter, none of the tables should have less than two pairs nor more than eight pairs of roller shafts in each of the two sets thereon, and preferably the several tables are identical with one another as to size, arrangement of the roller shafts on them, and mechanism for elevating and rotating them. To avoid interference between adjacent tables during their rotation, alternate tables along the length of the frame are raised, rotated and lowered in unison, and then the remaining tables are similarly shifted in unison. It will be apparent that where there are a plurality of tables along the length of the frame, as will usually be the case, the height to which each table is raised for its shifting must be such that the table is not only above the driving heads 17 on the frame but also above everything mounted on the table or tables adjacent to it, to be clear for its 180° rotation.

For each table 6 there is a hydraulic jack by which the table is lifted and lowered and which comprises a cylinder 19 secured in the frame 5, near the bottom thereof, and an upwardly projecting piston rod 20. A platform 21 that is secured to the piston rod 20 near the upper end thereof is confined to vertical motion with the piston rod by means of a pair of guide rods 22 which are fixed to the platform and project downward from it at opposite sides of the piston rod. The guide rods 22 extend down through guide brushings 23 which are fixed to the upper portion of the frame and in which they have a close sliding fit.

Secured to the upper side of the platform 21 in concentric relation to the piston rod 20 of the hydraulic jack is the annular inner race 35 of a swivel bearing 24 which has its outer race 36 secured to the underside of the table 6. The swivel bearing 24 thus supports the table for rotation relative to the platform 21 about the above mentioned vertical axis, which extends through the center of the table and which coincides with the axis of the piston rod 20. Gear teeth are formed on the outer race 36 of the swivel bearing 24, which thus comprises a ring gear 37. For 180° rotation of the table to shift it from one to the other of its operative orientations a reversible hydraulic rotary motor 26 is eccentrically mounted on the platform 21 and drives a pinion 27 which meshes with the ring gear 37.

In an arrangement which will be obvious to those skilled in the art, and which is therefore not shown, the motor 26 is so controlled, as by means of valves actuated by limit switches, that it is energized only when the table 6 is fully in its elevated position, and it turns the table through 180° in each rotational shift so that the table always moves back down to its operative position in an orientation for connection of the roller shafts of the operative set with the driving heads 17. Each 180° rotation of the table is in the direction opposite to the preceding one.

In the final part of downward motion of the table, a pair of locating pins 29, projecting upwardly from the top of the frame 5, are received in downwardly opening wells in bosses 31 fixed on the bottom of the table, for accurately establishing the table in each of its operative orientations and confining it against rotation out of the orientation in which it is established. The locating pins 29 and the bosses 31 in which they are received are so located as to be centered on the lateral centerline of the table when the table is in each of its operating positions, and they are spaced at like distances to opposite sides of the axis of table rotation. In accordance with well known practice, the wells in the bosses 31 are circular, and one of the locating pins 29 is of circular cross-section but the other is slabbed off to a substantially diamond shaped cross-section, and both locating pins have some upward taper.

The fully lowered operative position of the table is defined by pads 30 on its bottom, one near each of its four corners, in their engagement with correspondingly located supporting buttons 130 that are fixed on the top of the frame.

When the platform 21 is lowered, the jack 19, 20 must of course bring it to a position in which the pads 30 on the table are firmly engaged with the supporting buttons 130 on the frame. In many cases the jack can have a single-acting hydraulic cylinder 19, and the weight of the table and the apparatus mounted on it can be relied upon to bring the table down to such firm engagement.

Figure 7:
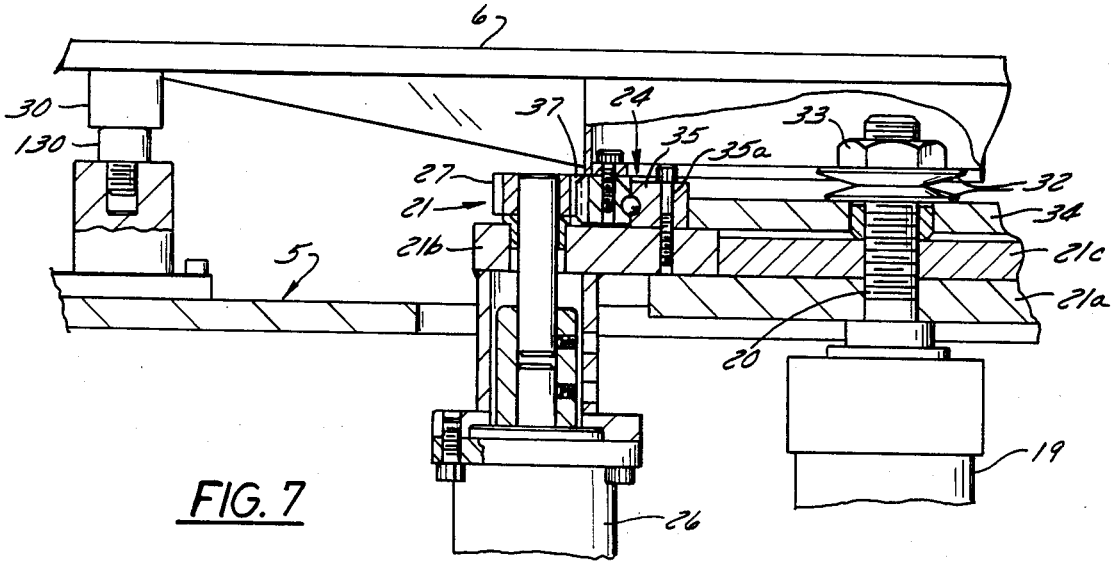
FIG. 7 is a fragmentary view in section, taken on a vertical plane containing the axes of the table elevating jack and the table rotating motor.

However, with a double-acting hydraulic cylinder 19 in the table elevating jack, the table must arrive at its fully lowered position a little before the piston rod 20 of the jack is fully retracted. The last bit of downward movement of the piston rod then assures firm seating of the table, but it should not impose an excessive downward force upon the table nor cause the inner race 35 of the swivel bearing 24 to be strongly urged downward relative to the outer race 36 of that bearing. Therefore, as shown in FIG. 7, the platform 21 comprises a rectangular supporting plate 21*a*, which has a threaded connection with the piston rod, and a larger rectangular platform plate 21*b* that overlies the marginal portions of the supporting plate 21*a*. The larger plate 21*b*, to which the guide rods 22 and the hydraulic motor 26 are secured, merely rests on the supporting plate 21*a*. A circular lower pilot plate 21*c* on top of the supporting plate 21*a* has a central hole therein through which the upper portion of the piston rod extends with a close fit, and it is in turn received with a close fit in a large central hole in the platform plate 21*b* for edgewise confining the latter. The inner race 35 of the swivel bearing overlies the platform plate 21*b* and is secured to it, as by bolts 35*a*. An upper pilot plate 34, of larger diameter than the lower pilot plate 21*c*, overlies the top surface of the platform plate 21*b* and is received within the inner race 35 of the swivel bearing. The upper end portion of the piston rod 24 extends through the center of the upper pilot plate 34 with a close but axially slidable fit. A large nut 33 is threaded onto the uppermost portion of the piston rod 24, and a pair of Belleville washers 32 are confined between that nut 33 and the upper pilot plate 34. Because the supporting plate 21*a* and the nut 33 are fixed to the piston rod 20, whereas the piston rod is axially slidable relative to the upper pilot plate 34, the Belleville washers 32, by their flexing, permit the piston rod to move all the way down to its fully retracted position, at which the flexed Belleville washers impose upon the platform plate 21*b*, through the upper pilot 34, a downward force that ensures firm seating of the table but is not large enough to impose an undesirable load on the swivel bearing 24.

For their rotational drive, the roller shafts 7 of each set A and B are arranged in groups, so that in each set A and B there is a group of roller shafts for each of the driving heads 17 on the machine frame. Only one lower roller shaft in each group is directly connected with the driving head 17 for the group, but all of the roller shafts of each group are so connected with one another, by gear transmission means 50 on the table 6, that they are constrained to rotate in unison. Since the transmission means for each group is independent of the transmission means for the other groups, it will be understood that there will be an integral number of groups of roller shafts on each table. Preferably each group consists of two pairs of roller shafts; but a group may comprise only one pair of roller shafts and under some conditions might comprise three pairs, depending upon the amount of torque that must be transmitted through the gears that connect the roller shafts of the group.

For its connection with the roller shafts of its group each driving head 17 has an output shaft 51 that projects away from its adjacent side 15 of the frame 5. All of the driving head output shafts 51 are driven from a single line shaft 55, so that all roller shafts are driven for rotation in unison.

Each of the driving heads 17 comprises essentially a gear box through which rotation is transmitted to the output shaft 51 of the driving head from the line shaft 55, which extends lengthwise parallel to the side 15 of the frame along which the driving heads are mounted. The line shaft is rotatably driven from a motor 53 that is mounted on the frame and is connected with the line shaft as by means of a drive chain transmission 56. The line shaft 55 can of course comprise a number of shaft segments that are connected end-to-end. Since the output shaft 51 of each driving head projects horizontally from it in the direction perpendicular to the line shaft 55, it will be understood that the driving head gears (not shown) can comprise either bevel gears or (as will usually be preferred) worm and worm gear transmissions.

At this point attention is directed to features of the machine of this invention that make it possible to remove and replace the forming rollers 8 on the roller shafts 7 of the idle set A or B while the roller shafts of the other set B or A are connected with the driving heads 17 and are being driven for production.

Each of the roller shafts 7 is journaled for rotation in a pair of bearings 57, 57' that are mounted, respectively, in an inboard roller support stand 58 near the inboard end of the roller shaft and in an outboard roller support stand 59 near its outboard end. Each of the inboard roller support stands 58 is a substantially U-shaped structure that is symmetrical to the longitudinal centerline of the table and provides support for the inboard bearings of two gear-connected groups of roller shafts, one group in each set. The inboard roller support stands 58 can be permanently fixed to the table. However, there is a separate outboard roller support stand 59 for each pair of roller shafts, and each outboard roller support stand is removably secured to the table as by means of bolts 60. To provide for removal and replacement of the forming roller 8 on each roller shaft, the portion of the roller shaft that extends from the forming roller to its outboard end should have such diameters at all points along its length that both the outboard bearing 57' and the forming roller can be slid axially off of the roller shaft past its outboard end.

Conventionally the gears that connect the roller shafts of each pair for unison rotation are fixed to those shafts near their ends adjacent the line shaft. In accordance with the present invention, by contrast, the gear transmission means 50 for each roller shaft group, whereby all of the roller shafts of the group are connected for unison rotation, is located adjacent to the inboard roller support structure 58, so that this transmission means is not in the way of axially outward removal of forming rollers 8 from the roller shafts 7 when an outboard support stand 59 has been removed from the table.

To provide for quick and easy establishment and disestablishment of positive driving connections between the roller shafts and the driving head output shafts 51, there is mounted on the outer end portion of the output shaft 51 of each driving head a concentric clutch element 62 that has a splined connection with that output shaft whereby the clutch element is constrained to rotate with it but is axially slidable relative to it between a driving position and a retracted position. In its driving position the clutch element engages an input shaft element 63 on one of the lower roller shafts of its group, and that input shaft element is of course coaxial with the output shaft 51 when the table is in operative position. The splined connection between the clutch element 62 and the output shaft 51 comprises an elongated key 64 that is received in radially opposite longitudinally extending grooves in the output shaft 51 and in the clutch element 62.

Fixed to the output shaft adjacent to the housing 117 of the driving head is a collar 61 that defines an axially outwardly facing circumferential shoulder on that shaft, and a coiled expansion spring 65 surrounds the shaft and reacts between the collar 61 and a circumferential flange 67 on the clutch element 62 to bias the latter axially outwardly along the output shaft toward its driving position.

For each driving head there is a double-acting hydraulic clutch-actuating jack 67, the cylinder of which is fixed to the frame 5 adjacent to the driving head housing 117 and below the level of the output shaft 51. The piston rod 68 of this jack is fixed to the medial portion of a yoke 69 that has an upper end portion embracing the clutch element 62 for the driving head. The yoke 69 opposes an axially outer side of the flange 67 on the clutch element 62 so that retraction of the piston rod 68 moves the clutch element axially, against the bias of the spring 65, to its retracted position in which the clutch element is axially spaced from the input shaft element 63 with which it cooperates. To minimize lateral deflecting forces on the piston rod 68 of the clutch actuating jack, a spring 72 is confined between a fixed abutment and the lower end of the yoke 69, to balance the forces imposed upon the yoke by the spring 65.

The hydraulic clutch-actuating jacks 67 can be so connected, in an obvious manner, that they can be actuated simultaneously and in timed relation to raising and lowering of the table or tables 6. Hence, at the conclusion of a production run with one set of roller shafts, the several clutch elements 62 can be shifted in an instant to their retracted positions, in which they are clear of the input shaft elements 63 for the roller shaft groups of that set, so that the table 6 can be raised, rotated and lowered to bring the input shaft elements 63 of the previously idle roller shaft set into juxtaposition to the output shafts 51 on the driving heads 17. The clutch actuating jacks 67 then extend simultaneously, permitting the clutch elements 62, under the bias of their respective springs 65, to shift back to their driving positions in which they engage the input shaft elements 63 of the new set.

The input shaft element 63 for each group of roller shafts could comprise a separate shaft, mounted like the roller shafts of its group and connected with them by means of the gear transmission 50, but it preferably comprises, as here shown, a projecting outboard end portion of one of the lower roller shafts 7L of the group. The input shaft element 63 preferably has a frustoconical taper to be receivable in a correspondingly tapered well 73 in its cooperating clutch element 62, and on its outer end it has an outwardly projecting diametrically extending rib or tongue 74 that is closely receivable in a mating slot in the bottom of the well 73. If the input shaft element 63 is not in such a rotational orientation that its rib or tongue 74 can enter the mating slot in the clutch element as the clutch element shifts towards its driving position, the clutch spring 65 accommodates such misalignment, and after a fraction of a revolution of the output shaft the rib 74 slips into the slot and the clutch is fully engaged.

In accordance with conventional practice, the roller shaft bearings 57, 57' are so mounted in the roller support stands 58 and 59 that the lower roller shaft 7L of each pair is at a fixed elevation above the level of the table but the upper roller shaft 7U of the pair is vertically adjustable relative to the lower one. Preferably all of the driving head output shafts 51 have their axes in a common horizontal plane, and all of the lower roller shafts 7L likewise have their axes in a common horizontal plane that coincides with the plane of the output shaft axes when the table 6 is in its lowered operative position.

The transmission means 50 for each roller shaft group, whereby the roller shafts of the group are connected with one another for unison rotation, is generally conventional in that it comprises a spur gear 77 fixed to each roller shaft, but in this case near its inboard end. The gears 77 on the roller shafts of each pair are connected by means of intermediate spur gears 78 that are supported by links 79 in a known arrangement whereby the intermediate gears 78 are maintained in meshing engagement with one another and with the respective roller shaft gears 77 in all positions of vertical adjustment of the upper roller shaft. The two pairs of roller shafts that normally comprise a group are spaced apart by a fixed distance and can therefore be connected for unison rotation by means of other intermediate gears 80 that mesh with the gears 77 on the lower roller shafts 7L of those two pairs.

From the foregoing description it will be apparent that the machine of this invention can be very quickly converted from production of one type of product to production of another. It will also be apparent that because the set of roller shafts newly brought into operation is in exactly the same position as the set used for the previous production run, the operative set of roller shafts will always be aligned with other machines in the processing line in which the roller forming machine is incorporated. Meanwhile, the idle set of roller shafts is in a position in which the forming rollers on them can be readily changed if such a change is needed for the next subsequent production run.

What is claimed as the invention is:

1. A roller forming machine that can be quickly converted from production of workpieces of one type to production of workpieces of another type, comprising a plurality of lengthwise parallel rotatable roller shafts that are disposed in pairs, each pair comprising an upper roller shaft and a lower roller shaft, to each of which one of a pair of mating forming rollers is detachably securable, said machine being characterized by:

A. a frame having a pair of opposite sides;

B. driving means on said frame adjacent to one of said sides thereof comprising
  (1) rotatable clutch means shiftable away from said one side of the frame to a driving position and shiftable towards that side of the frame to a retracted position,
  (2) means for driving said clutch means in rotation, and
  (3) means for shifting said clutch means alternatively and selectably to each of its said positions;

C. an elongated table
  (1) having a pair of opposite lengthwise extending sides and
  (2) on which said roller shafts are confined to rotation and disposed with their lengths transverse to said sides of the table;

D. said roller shafts being arranged on said table in two sets,
  (1) one set laterally inwardly adjacent to each of said sides of the table and
  (2) each set comprising a plurality of pairs of roller shafts that are spaced apart along its adjacent side of the table;

E. table shifting means on said frame, connected with said table
  (1) for moving the table vertically between
    (a) an elevated position in which the table is spaced above said driving means and
    (b) a lowered operative position and
  (2) for rotating the table in its elevated position through 180° about a vertical axis intermediate said sides of the table so that the table, when lowered to its operative position, can have a selected one of its two sets of roller shafts adjacent to said drive means; and F. rotatable input shaft means on said table for each of said sets of roller shafts, the input shaft means for each set of roller shafts
  (1) being connected with the roller shafts of its set for rotatably driving the same,
  (2) projecting towards the side of the table adjacent to its set, and
  (3) being adapted for driving connection with said clutch means when the latter is in its driving position and its set of roller shafts is adjacent to said drive means.

2. A roller forming machine that can be quickly converted from production of workpieces of one type to production of workpieces of another type, comprising:

A. an elongated relatively stationary frame having a pair of opposite sides that extend along its length;

B. a plurality of driving heads mounted on said frame adjacent to one of said sides thereof and at spaced intervals along the same, each said driving head having
  (1) a rotatable output shaft projecting therefrom to have an inner end remote from said one side of the frame and
  (2) a clutch element coaxially mounted on the inner end portion of its output shaft for rotation therewith and for axial sliding relative thereto to and from a driving position towards which the clutch element is biased and at which it is nearest said other side of the frame;

C. means on said frame for rotatably driving all of said output shafts in unison;

D. an elongated table having a pair of opposite sides that extend along its length;

E. a plurality of pairs of roller shafts mounted on said table to be confined to rotation relative thereto,
  (1) each said roller shaft having its length lateral to the table and being adapted to have a forming roller removably fixed coaxially thereto,
  (2) each pair of roller shafts comprising an upper shaft and a lower shaft to which mating forming rollers are respectively securable,
  (3) said pairs of roller shafts being arranged in two sets
    (a) with one of those sets adjacent to each of said sides of the table and
    (b) with each set comprising a plurality of said pairs disposed at spaced intervals along its adjacent side of the table, and
  (4) the roller shafts of each set further comprising a plurality of groups, one group for each said output shaft, each group
    (a) comprising at least one pair of roller shafts and
    (b) having a transmission means which is independent of the transmission means for the other groups and whereby the roller shafts of the group are constrained to rotate in unison;

F. an input shaft element on said table for each group of roller shafts of each set thereof, connected with the transmission means for its group and rotation of which imparts rotation to the roller shafts of its group,
  (1) each said input shaft element projecting towards the one of said sides of the table that is adjacent to the roller shafts of its group, and
  (2) being adapted to have a coaxial driving connection with the clutch element on the output shaft for its group;

G. table shifting means on said frame, connected with said table,
  (1) for moving said table vertically between
    (a) an elevated position in which the table is spaced above the level of the tops of the driving heads and
    (b) a lowered operative position in which each input shaft element for the groups of roller shafts of one set is coaxial with and edgewise adjacent to the output shaft for its group, for driving connection with that output shaft through the clutch element thereon in its driving position, and
  (2) for rotating said table, in its elevated position, through 180° so that upon lowering of the table to its operative position the input shaft elements for the groups of roller shafts of the other set can be connected with the output shafts for their respective groups; and H. clutch disengaging means on said frame for shifting all of said clutch elements axially away from their driving positions to retracted positions in which the clutch elements are clear of the input shaft elements and said table, to permit vertical movement of the table between its elevated and operative positions.

3. The roller forming machine of claim 2, further characterized in that: said input shaft element for each group of roller shafts comprises a projecting end portion of one of the roller shafts of the group.

4. The roller forming machine of claim 3, further characterized in that:

said transmission means for each group of roller shafts comprises a gear coaxially fixed to each roller shaft of the grouup near the end of the roller shaft that is remote from its adjacent one of said sides of the table.

5. A roller forming machine that can be quickly converted from production of workpieces of one type to production of workpieces of another type, comprising a plurality of lengthwise parallel rotatable roller shafts that are disposed in pairs, each pair comprising an upper roller shaft and a lower roller shaft to each of which one of a pair of mating forming rollers is detachably securable, said machine being characterized by:

A. a relatively stationary frame having a pair of opposite sides;

B. a plurality of output shafts on the top of said frame, confined to rotation relative thereto at fixed locations adjacent to one of said sides thereof and at spaced intervals along that side, each said output shaft projecting away from said one side of the frame to have an end portion remote therefrom;

C. drive means on the frame connected with said output shafts to drive them for unison rotation;

D. a plurality of clutch elements, one for each said output shaft, each mounted on said end portion of its output shaft for rotation therewith but for lengthwise sliding relative thereto away from said one side of the frame to a driving position and towards that side of the frame to a retracted position;

E. a table having a pair of opposite sides and having a centerline parallel to said sides and between them;

F. roller shaft supporting means on said table for confining each said roller shaft to rotation relative to the table and whereby the roller shaft pairs are supported in two sets, one set adjacent to each of said sides of the table, with every roller shaft of a set oriented to have an outboard end near its adjacent side of the table and an inboard end near said centerline, said roller shaft supporting means comprising (1) inboard roller shaft carrying means near said centerline, supporting inboard end portions of the roller shafts, and (2) an outboard roller support stand for each pair of roller shafts, each said outboard roller support stand (a) supporting outboard end potions of the roller shafts of its pair and (b) being detachably secured to the table to provide for axial removal from each roller shaft of its pair of a forming roller secured thereon at the inboard side of the outboard roller support stand;

G. table shifting means on said frame, connected with said table, (1) for rotating the table through 180° about a vertical axis to shift the table from one to the other of two selectable orientations, and (2) for moving the table in translation between (a) a shifting position in which the table is spaced from the frame to be rotatable for change of its orientation, and (b) an operative position in which the table is supported on the frame and in which, depending upon its selected orientation, a selected one of said two sets of roller shaft pairs is adjacent to said clutch elements;

H. each of at least certain of the lower roller shafts of each said set having an outboard end portion that comprises a coaxial input shaft element which is drivingly engageable by one of said clutch elements upon sliding of that clutch element to its driving position when the table is in its operative position and is oriented with that input shaft element adjacent to the clutch element; and I. transmission means comprising a gear secured to each roller shaft near the inboard end thereof for constraining all of the other roller shafts of each set to rotate in unison with said certain lower roller shafts of the set.

6. The roller forming machine of claim 5, further characterized by:

(1) each said clutch element having a coaxial well which opens away from said one side of the frame and wherein an input shaft element is coaxially receivable; and (2) one of the last mentioned elements having an axially projecting diametral rib which is receivable in a closely fitting diametral groove in the other of those elements to provide a driving connection between the clutch element and the input shaft element.

7. The machine of claim 6, further characterized by: yielding means biasing each of said clutch elements towards its driving position.

8. The machine of claim 7, further characterized by: actuating means for sliding each of said clutch elements against the bias of said yeilding means to its retracted position, to provide for movement of all of the clutch elements simultaneously to their retracted positions and simultaneously to their driving positions.

9. A roller forming machine comprising a plurality of lengthwise parallel rotatable roller shafts that are disposed in spaced apart pairs, each pair comprising an upper roller shaft and a lower roller shaft to each of which one of a pair of mating forming rollers is detachably securable, characterized by:

A. a frame having a pair of opposite sides;

B. driving means on said frame, adjacent to one of said sides thereof, comprising (1) rotatable clutch means shiftable axially away from said side of the frame to a driving position and shiftable axially towards said side of the frame to a retracted position, and (2) means for driving said clutch means in rotation;

C. a table having a pair of opposite sides and a centerline which is between those sides and substantially parallel to them;

D. roller shaft supporting means on said table whereby said roller shafts are confined to rotation relative to the table, are disposed in two sets, one laterally inwardly adjacent to each of said sides of the table, and are so positioned that every roller shaft of each set has an outboard end near its adjacent side of the table and has an inboard end near side centerline, said roller shaft supporting means comprising:

(1) means near said centerline for supporting the inboard end portion of all of said roller shafts and (2) an outboard roller support stand for each pair of roller shafts of each set, each said stand being detachably secured to the table to permit forming rollers that are secured to the roller shafts of its pair, intermediate their ends, to be axially removed from those roller shafts past their outboard ends;

E. table shifting means on said frame, connected with said table (1) for rotating the table through 180° about a vertical axis to shift the table from one to the other of two selectable orientations, and (2) for moving the table intranslation between (a) a shifting position in which the table is spaced from the frame to be rotatable for change of its orientation and (b) an operative position in which the table is supported on the frame and in which depending upon its selected orientation, a selected one of said two sets of roller shafts is adjacent to said driving means;

F. a rotatable input shaft means on the table for each of said sets of roller shafts, each said input shaft means projecting towards the side of the table adjacent to its set and being adapted for driving connection with said clutch means when its set of roller shafts is adjacent to said driving means and the clutch means is in its driving position; and G. a gear secured to every roller shaft near the inboard end thereof to provide for rotatably driving all of the roller shafts of each set from the input shaft means for the set.

* * * * *